US011951538B2

(12) United States Patent
Kotlarek et al.

(10) Patent No.: US 11,951,538 B2
(45) Date of Patent: Apr. 9, 2024

(54) HOLLOW AUTOMOTIVE PARTS AND METHODS FOR FABRICATING HOLLOW CASTINGS

(71) Applicant: GM GLOBAL TECHNOLOGY OPERATIONS LLC, Detroit, MI (US)

(72) Inventors: Adam G. Kotlarek, Berkley, MI (US); Frank D. Risko, Clarkston, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 433 days.

(21) Appl. No.: 17/157,293

(22) Filed: Jan. 25, 2021

(65) Prior Publication Data

US 2022/0234097 A1 Jul. 28, 2022

(51) Int. Cl.

| | |
|---|---|
| ***B22D 17/00*** | (2006.01) |
| ***C22C 21/08*** | (2006.01) |
| ***C22F 1/047*** | (2006.01) |

(52) U.S. Cl.

CPC ..... *B22D 17/007* (2013.01); *C22C 21/08* (2013.01); *C22F 1/047* (2013.01)

(58) Field of Classification Search

None

See application file for complete search history.

(56) References Cited

U.S. PATENT DOCUMENTS

2007/0047082 A1 3/2007 Seaver et al.

FOREIGN PATENT DOCUMENTS

| | | | |
|---|---|---|---|
| CN | 108237210 A | * | 7/2018 |
| DE | 3812510 A1 | | 10/1989 |
| DE | 102009020305 A1 | | 12/2009 |

OTHER PUBLICATIONS

Anderson, Kevin, ASM Handbook: vol. 2A, Aluminum Science and Technology, ASM International, pp. 400-408,655-692. (Year: 2018).*

* cited by examiner

*Primary Examiner* — George Wyszomierski
*Assistant Examiner* — Janell C Morillo
(74) *Attorney, Agent, or Firm* — Lorenz & Kopf LLP

(57) ABSTRACT

Hollow automotive parts, methods for fabricating hollow automotive parts, and methods for fabricating hollow castings are provided. An exemplary method for fabricating a hollow casting includes casting at least a first casting section and a second casting section from a slurry using a semi-solid casting process, and welding the casting sections together at interfaces therebetween.

16 Claims, 2 Drawing Sheets

HOLLOW AUTOMOTIVE PARTS AND METHODS FOR FABRICATING HOLLOW CASTINGS

INTRODUCTION

The technical field generally relates to casting methods and cast parts, and more particularly relates to the fabrication of hollow automotive parts by semi-solid high-pressure die-casting processes.

In order to increase fuel economy in automotive vehicles, there has been an emphasis on reducing vehicle weight. Hollow parts are typically the lightest weight shapes that can be used for structural applications in automotive vehicles. With all of the part material at the outer diameter and no material at the centerline, i.e., at the void of the hollow part, hollow parts allow for maximum resistance to force and deflection without sacrificing weight that does not contribute to performance.

For certain hollow automotive parts, stiffness is typically more critical than strength. Aluminum, including aluminum alloys based on the aluminum-silicon eutectic system with magnesium, iron, zinc and/or copper additions, has been found to offer sufficient stiffness and strength for use in certain automotive parts. Further, such aluminum materials exhibit low density, high thermal conductivity, good castability, and excellent low-temperature strength. Also, aluminum does not require coatings for sufficient corrosion resistance.

However, the fabrication of hollow parts from aluminum material typically has necessitated use of cores during the casting process. For example, current casting technology uses sand cores to create hollow castings. Further, in some practices, complex multi-core sand castings are used to fabricate hollow aluminum castings with complex casting geometries. Cores are made with separate, costly, tooling. Also, cores typically must be made ahead of time, transported to the molding department and placed into the mold set. The use of cores may require the mold set to be larger and include openings to allow for removal of the core. Often, cored castings require extra cleaning and trimming. Generally, the use of cores, and multi-core castings specifically, increases the fabrication cost of castings.

Accordingly, it is desirable to provide methods for fabricating hollow castings that include coreless processes. In addition, it is desirable to provide hollow automotive parts that include two casting sections that are welded together with sufficient weld strength and which exhibit mechanical properties equal to or better than the mechanical properties of hollow castings fabricated by current processes. Furthermore, other desirable features and characteristics of the present invention will become apparent from the subsequent detailed description and the appended claims, taken in conjunction with the accompanying drawings and the foregoing technical field and background.

SUMMARY

In one embodiment, a method for fabricating a hollow casting is provided. The method includes casting at least a first casting section and a second casting section from a slurry using a semi-solid casting process. The method further includes welding the casting sections together at interfaces therebetween.

In exemplary embodiments, welding the casting sections together at interfaces therebetween comprises using a capacitive discharge welding process.

In exemplary embodiments, the method includes forming the slurry by heating an ingot at a temperature of at least the liquidus temperature of the ingot to melt the ingot.

In exemplary embodiments, the method includes creating the slurry as a low volume fraction solid aluminum slurry. In other exemplary embodiments, the method includes creating the slurry as a high volume fraction solid aluminum slurry.

In exemplary embodiments, the semi-solid casting process is a high pressure die-casting (HPDC) process. In other exemplary embodiments, the semi-solid casting process is selected from rheocasting, thixocasting, thixomolding, and wrought processes. For example, the semi-solid casting process may be a rheocasting process.

In exemplary embodiments, casting at least a first casting section and a second casting section from a slurry using a semi-solid casting process comprises forming the first casting section with a first surface and a second surface and forming the second casting section with a first surface configured to mate with the first surface of the first casting section and with a second surface configured to mate with the second surface of the first casting section.

In exemplary embodiments, the method includes casting the first casting section, the second casting section, and a third casting section from the slurry using a semi-solid casting process.

In one embodiment, a method for fabricating a hollow automotive part is provided. The method includes forming an upper mold and a lower mold; injecting a charge of a semi-solid slurry into each of the upper mold and the lower mold to form an upper section in the upper mold and a lower section in the lower mold, wherein each section is formed with a lowest material porosity at a first surface and at a second surface; and performing a capacitive discharge welding process to weld the first surface of the upper section to the first surface of the lower section and the second surface of the upper section to the second surface of the lower section.

In exemplary embodiments, the semi-solid slurry comprises aluminum. In exemplary embodiments, the semi-solid slurry comprises an aluminum alloy.

In exemplary embodiments, the method includes forming the semi-solid slurry by heating an ingot comprising an aluminum material at a temperature of at least the melting point of the aluminum material to melt the ingot.

In exemplary embodiments, the method includes creating the semi-solid slurry as a low volume fraction solid aluminum slurry. In other exemplary embodiments, the method includes creating the semi-solid slurry as a high volume fraction solid aluminum slurry.

In one embodiment, a hollow automotive part is provided. The hollow automotive part includes an upper casting section formed from a semi-solid casting process and having a first surface and a second surface; and a lower casting section formed from a semi-solid casting process and having a first surface and a second surface; wherein the first surface of the lower casting section mates with the first surface of the upper casting section, wherein the second surface of the lower casting section mates with the second surface of the upper casting section, and wherein the first surfaces are welded to each other and the second surfaces are welded to each other by a capacitive discharge welding process.

In exemplary embodiments of hollow automotive part, the upper casting section and the lower casting section comprise an aluminum alloy.

In exemplary embodiments of hollow automotive part, the aluminum alloy comprises silicon and magnesium, no more than 0.2% iron and no more than 0.1% zinc.

In exemplary embodiments of hollow automotive part, the hollow automotive part has a minimum radial thickness of at least 3 mm.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

The exemplary embodiments will hereinafter be described in conjunction with the following drawing figures, wherein like numerals denote like elements, and wherein.

DETAILED DESCRIPTION

Figure 1:
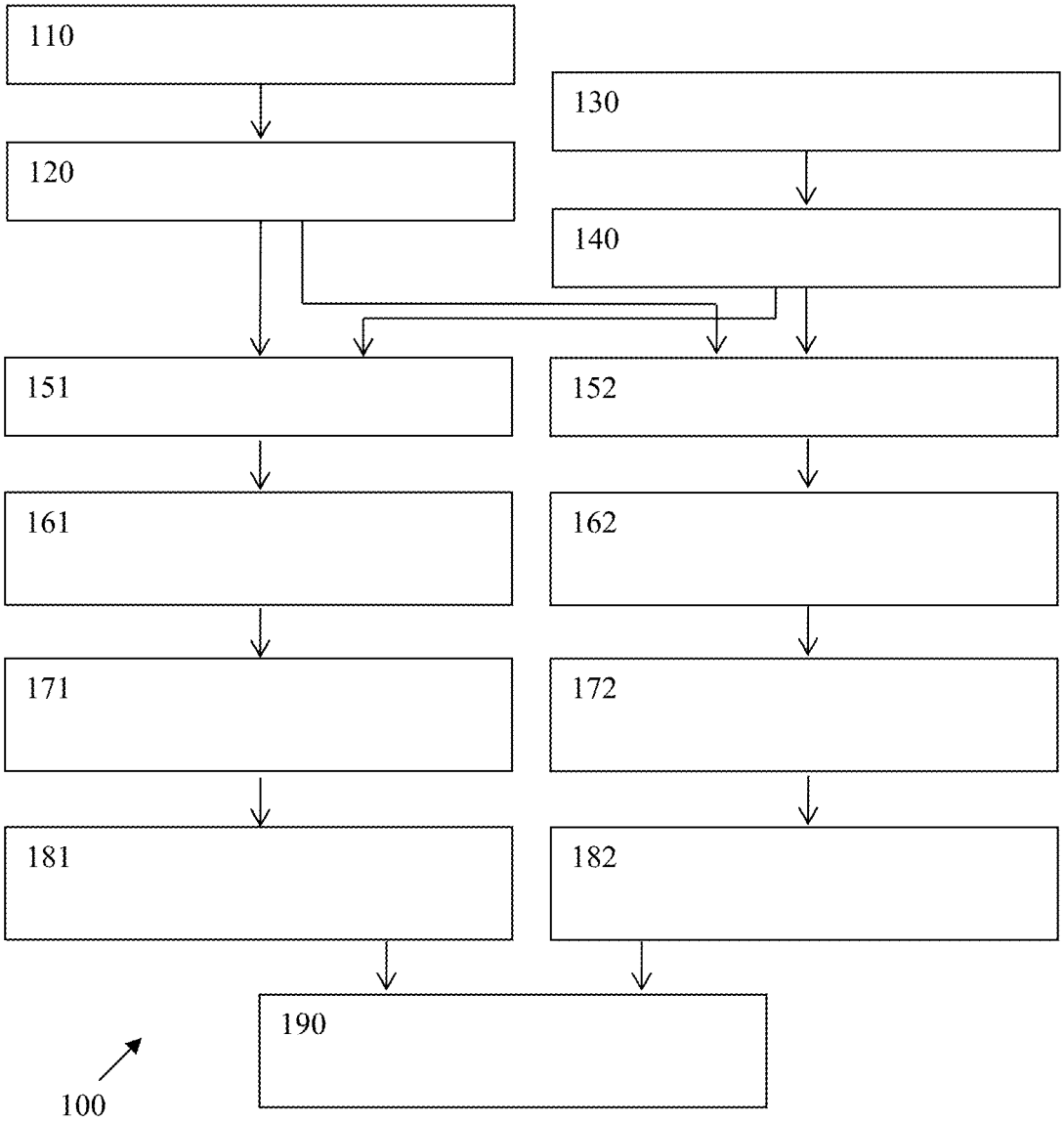
FIG. 1 is flow chart illustrated a method for fabricating a hollow part or component in accordance with an embodiment.

The following detailed description is merely exemplary in nature and is not intended to limit the application and uses. Furthermore, there is no intention to be bound by any expressed or implied theory presented in the preceding technical field, background, brief summary or the following detailed description.

As used herein, a "hollow part" is a part having an internal void that is surrounded by part material. In certain embodiments, the internal void may be closed and the part may have a shape similar to a balloon. In certain embodiments, the internal void is open and is in communication with an opening through one surface of the part such that the part has a shape similar to a basket. In certain embodiments, the internal void is open and is in communication with an opening through two surfaces of the part such that the part has a shape similar to a ring or doughnut.

As used herein, the word "exemplary" means "serving as an example, instance, or illustration". As used herein, "a," "an," or "the" means one or more unless otherwise specified. The term "or" can be conjunctive or disjunctive. Open terms such as "include," "including," "contain," "containing" and the like mean "comprising." In certain embodiments, numbers in this description indicating amounts, ratios of materials, physical properties of materials, and/or use are may be understood as being modified by the word "about". The term "about" as used in connection with a numerical value and the claims denotes an interval of accuracy, familiar and acceptable to a person skilled in the art. In general, such interval of accuracy is ±10%. All numbers in this description indicating amounts, ratios of materials, physical properties of materials, and/or use may be understood as modified by the word "about," except as otherwise explicitly indicated.

As used herein, the "%" or "percent" described in the present disclosure refers to the weight percentage unless otherwise indicated. Further, as used herein, an element identified as a "material" includes at least 50 wt. % of the recited material. As used herein, an element identified as "primarily material" is a material that includes at least 90 wt. % of the recited material.

Further, terms such as "upper", "lower", "above," "over," "below," "under," "upward," "downward," et cetera, are used descriptively of the figures, and do not represent limitations on the scope of the subject matter, as defined by the appended claims. Any numerical designations, such as "first" or "second" are illustrative only and are not intended to limit the scope of the subject matter in any way. It is noted that while embodiments may be described herein with respect to automotive applications, those skilled in the art will recognize their broader applicability.

Embodiments herein are related to methods for fabricating hollow castings for use as automotive parts, and to the high-strength hollow aluminum parts or components that are fabricated. As described herein, exemplary embodiments provide the ability to create a hollow casting without using a core during the casting process. Further, exemplary embodiments obviate the need for the use of complex, multi-core sand castings while improving mechanical properties and enabling fabrication of both simple and complex casting geometries.

Referring to FIG. 1, a method 100 for fabricating a hollow automotive part is illustrated in a flow chart. As illustrated, the method 100 may include designing and testing a mold set, including at least two molds, for casting at least two mating casting sections at action block 110. During design and testing, porosity of casting sections, particularly at the mating surfaces of the casting sections where the casting sections will be welded to one another, may be optimized by geometric design and by process design.

The method may continue at action block 120 by forming a mold set, for example a first mold and a second mold for forming first and second casting sections that mate together, such as in a clam shell design. In other embodiments, three or more molds may be formed for casting three or more mating casting sections. In exemplary embodiments, the first mold and the second mold may be considered to be an upper mold and a lower mold, respectively, the first casting section formed in the first mold may be considered to be an upper casting section, and the second casting section formed in the second mold may be considered to be a lower casting section.

As shown, the method 100 includes preparing a melt from an ingot at action block 130. In an exemplary embodiment, the ingot is a solid aluminum ingot, such as an aluminum alloy based on the aluminum-silicon eutectic system with magnesium, iron, zinc and/or copper additions. For example, the ingot may be a solid A356 aluminum ingot including an aluminum alloy with 7% silicon and 0.3% magnesium, and with a maximum amount of 0.2% iron and a maximum amount of 0.10% zinc.

Preparation of the melt includes heating the ingot to a temperature above the liquidus temperature of the ingot, i.e., the lowest temperature at which the alloy is completely liquid. After preparation of the melt, the entire ingot is liquid.

The method 100 further includes creating a slurry from the melt at action block 140. As used herein, a "slurry" is neither completely solid nor completely liquid and may be created by lowering the temperature of the liquid into a mixed solid/liquid slurry range. An exemplary slurry may be a low volume fraction solid slurry or a high volume fraction solid slurry. An exemplary slurry may have a solid volume fraction of at least 1%, such as at least 2%, for example at least 5%, such as at least 10%, for example at least 15%, such as at least 20%, for example at least 25%, such as at least 30%, for example at least 35%, such as at least 40%, or for example at least 45%. An exemplary slurry may have a solid volume fraction of at most 60%, such as at most 50%, for example at most 45%, such as at most 40%, for example at most 35%, such as at most 30%, for example at most 25%, such as at most 20%, for example at most 15%, such as at most 10%, for example at most 5%, or at most 2%.

In an exemplary embodiment, action block 140 includes creating the slurry as a low volume fraction solid aluminum slurry. Any suitable process may be used to create the slurry as a low volume fraction solid aluminum slurry. An exemplary process creating the slurry as a low volume fraction solid aluminum slurry is a gas induced semi-solid (GISS) process. In another exemplary embodiment, action block 140 includes creating the slurry as a high volume fraction solid aluminum slurry. Any suitable process may be used to create the slurry as a high volume fraction solid aluminum slurry. An exemplary process for creating the slurry as a high volume fraction solid aluminum slurry is a swirled equilibrium enthalpy device (SEED) process.

The method continues with the parallel formation of first and second casting sections. Such formation may occur simultaneously or at different times, at the same location or at different locations. Thus, action blocks 130 and 140 may be performed to provide a single slurry for use in forming the first and second casting sections, or action blocks 130 and 140 may be performed at different times and/or different locations to provide different batches of the slurry for forming the first and second casting sections.

As shown, a first casting section is formed by action blocks 151, 161, 171, and 181 and a second casting section is formed by action blocks 152, 162, 172, and 182. At action blocks 151 and 152, the slurry created at action block 140 is injected into the first and second molds. Typically, the slurry may be prepared as a single charge or shot and injected into the respective mold by a ram mechanism. At action blocks 161 and 162, the slurry solidifies into the respective casting sections. Action blocks 151 and 161 and action blocks 152 and 162 may be considered to be part of a semi-solid casting process, such as a semi-solid high-pressure die-casting (HPDC) process. In exemplary embodiments, the semi-solid casting process is a rheocasting, thixocasting, thixomolding, or wrought process.

In an exemplary embodiment, the casting process includes forming the first casting section with a first surface and a second surface and forming the second casting section with a first surface configured to mate with the first surface of the first casting section and with a second surface configured to mate with the second surface of the first casting section.

In an exemplary embodiment, each casting section is formed with a lowest material porosity at the first and second surfaces, as compared to the porosity at of the rest of the respective casting section. Specifically, through design of the mold set and process parameters, the slurry solidifies with a minimum material porosity at the first and second surfaces.

Thereafter, at action blocks 171 and 172, the first and second casting sections are removed from the respective molds. The method 100 may include degating the first and second casting sections at action blocks 181 and 182.

The method 100 further includes welding the first casting section and the second casting section together at action block 190 to form the hollow casting. Specifically, the casting sections may be contacted to one another such that the mating surfaces of the two casting sections are engaged to form two interfaces therebetween. For example, a first interface may be formed between first surfaces of the two casting sections and a second interface may be formed between second surfaces of the two casting sections. Then, the method welds the first casting section to the second casting section at the two interfaces therebetween. In an exemplary embodiment, the method 100 uses a capacitive discharge welding process to weld the first casting section to the second casting section at the two interfaces therebetween.

In certain embodiments, each casting section forms about half of the hollow casting. For example, each of the sections is at least 45 wt % of the hollow casting, such as at least 48 wt % of the hollow casting, for example at least 49 wt % of the hollow casting, or 50 wt % of the hollow casting. In other embodiments, the mold set may include three or more molds and each casting section may form significantly less than half of the hollow casting.

Figure 2:
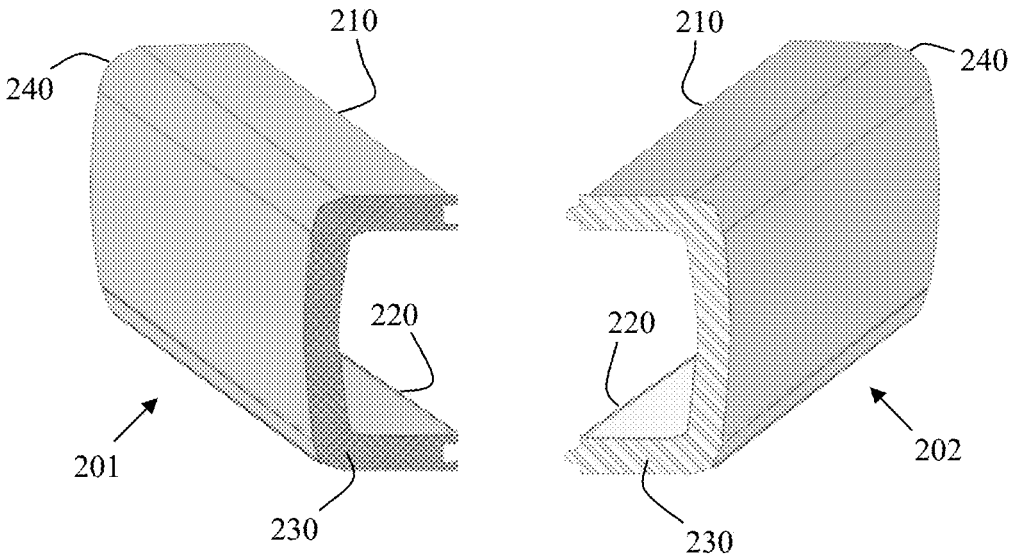
FIG. 2 is a schematic perspective view of two casting sections in accordance with an embodiment.

Referring to FIG. 2, a first or upper casting section 201 and a second or lower casting section 202 are depicted after casting and before being welded together. As shown, each casting has a first surface 210 and a second surface 220. Each surface 210 and 220 extends from a first end 230 to a second end 240. As shown, the surfaces 210 and 220 face one another. The first surface 210 of the first section 201 mates with the first surface 210 of the second section 202, and the second surface 220 of the first section 201 mates with the second surface 220 of the second section 202. Specifically, the surfaces 210 and 220 may be formed with engagement features, such as a tongue and groove design as shown.

In an exemplary embodiment, each casting section 201 and 202 is an aluminum material, such as an aluminum alloy based on the aluminum-silicon eutectic system with magnesium, iron, zinc and/or copper additions. For example, each casting section 201 and 202 may be A356 aluminum, an aluminum alloy with 7% silicon and 0.3% magnesium, and with a maximum amount of 0.2% iron and a maximum amount of 0.10% zinc.

Porosity of a body is defined as the ratio of the pore volume to the whole nominal volume of the body and may be measured in terms of the porosity area fraction (i.e., the area occupied by the porosity divided by the whole area of the body in interest). Studies have found that the porosity of conventional die castings is in the range of about 2.4%. The porosity levels in the semi-solid casting sections 201 and 202 are less than that of conventional die castings. For example, the porosity of the semi-solid casting sections 201 and 202 may be less than 2.4%, such as less than 2.2%, for example less than 2.0%, such as less than 1.8%, for example less than 1.6%, such as less than 1.4%, for example less than 1.2%, such as less than 1.0%, for example less than 0.9%, such as less than 0.8%, for example less than 0.7%, such as less than 0.6%, for example less than 0.5%, such as less than 0.4%, for example less than 0.3%, such as less than 0.2%, for example less than 0.1%, such as less than 0.09%, for example less than 0.08%, such as less than 0.07%, for example less than 0.06%, such as less than 0.05%, for example less than 0.04%, such as less than 0.03%, for example less than 0.02%, such as less than 0.01%. Exemplary casting sections 201 and 202 may have a porosity of greater than 0.001%. In an exemplary embodiment, the first surfaces 210 and the second surfaces 220 have a porosity that is equal to or less than the porosity of the rest of the surfaces of the sections 201 and 202. The extremely low porosity of the casting sections 201 and 202 in general, and of the first surfaces 210 and second surfaces 220 specifically, provide for excellent mechanical properties.

Figure 3:
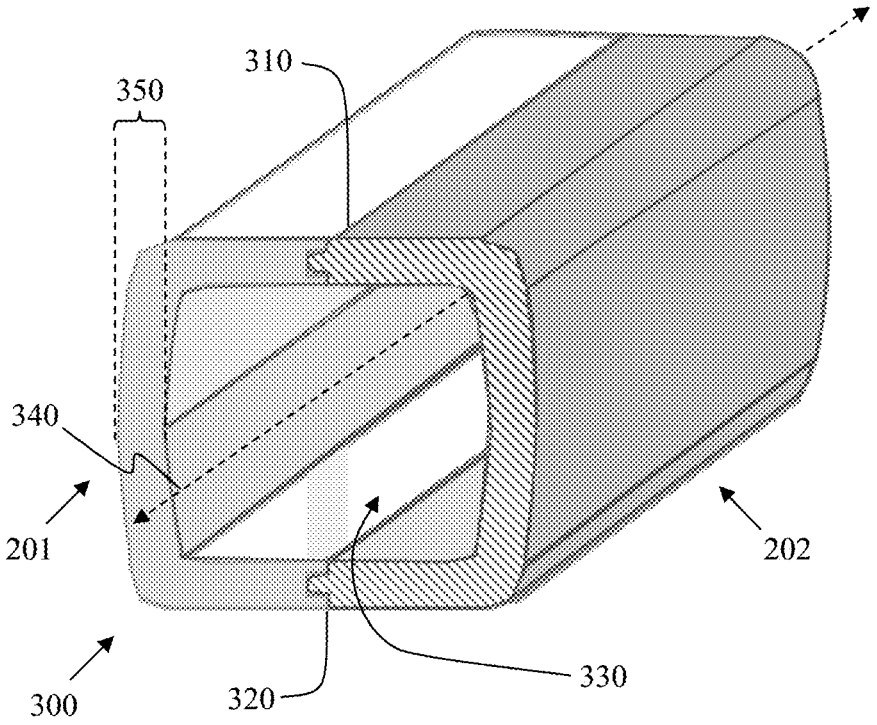
FIG. 3 is a schematic perspective view of a hollow part or component in accordance with an embodiment.

FIG. 3 illustrates a hollow part or component 300 formed from the casting sections 201 and 202 of FIG. 2 and having a simple symmetrical tubular structure. As shown, the first surfaces 210 of each section 201 and 202 abut and engage one another at an interface 310. Likewise, the second surfaces 220 of each section 201 and 202 abut and engage one another at an interface 320. In the exemplary hollow part 300, the sections 201 and 202 are welded together at the interfaces 310 and 320.

As shown, the hollow part 300 encircles an open void 330. Further, the illustrated hollow part 300 defines a central axis 340. A radial thickness 350 is defined as a thickness of the hollow part 300 along a radial extending outward from the axis 340, i.e., a thickness from the inner surface facing the open void 330 to the outer surface. While a radius thickness is identified, the hollow part 300 may have a thickness in any direction, given the design of the part. An exemplary hollow part 300 has a minimum thickness of at least 3 mm, such as at least 3.5 mm, for example at least 4 mm.

Exemplary hollow parts fabricated as described herein exhibit equivalent or improved tensile strength, yield strength and percent elongation as compared to conventionally fabricated hollow parts.

As described herein, hollow parts or components are fabricated without specialty coring systems. Rather, exemplary casting sections are formed by semi-solid HPDC processing. As a result, the casting sections are formed with low porosity, providing for effective welding. Also, the described semi-solid HPDC process provides for dimensional control of the joint or interface to be welded, thereby eliminating the need for additional processing, such as machining, prior to welding.

Further, exemplary casting sections are welded together, such as by capacitive discharge welding, to form hollow parts or components. Due to the low heat input into the casting sections from the capacitive discharge welding process, less part distortion is exhibited. Further, the capacitive discharge welding process creates a smaller heat-affected zone in the casting sections due to low heat input, resulting in less property degradation. Also, the capacitive discharge welding process provides for low cycle times as compared to other metal fusing or joining operations.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A method for fabricating a hollow casting, the method comprising:

casting a first casting section and a second casting section from an aluminum slurry using a semi-solid casting process to form each casting section with a lowest material porosity at a first surface and a second surface and with a material porosity not less than the lowest material porosity in a remainder of each respective casting section; and welding the casting sections together at the respective first surfaces and at the respective second surfaces to form the hollow casting as a ring shape in which an open void is encircled by the first casting section and the second casting section.

2. The method of claim 1 wherein welding the casting sections together comprises using a capacitive discharge welding process.

3. The method of claim 1 further comprising forming the slurry by heating an ingot at a temperature of at least the liquidus temperature of the ingot to melt the ingot.

4. The method of claim 1 further comprising creating the aluminum slurry with a gas induced semi-solid (GISS) process.

5. The method of claim 1 further comprising creating the aluminum slurry with a swirled equilibrium enthalpy device (SEED) process.

6. The method of claim 1 wherein the semi-solid casting process is a high pressure die-casting (HPDC) process.

7. The method of claim 1 wherein at least a portion of the remainder of each respective casting section has a material porosity greater than the lowest material porosity.

8. The method of claim 1 wherein the semi-solid casting process is a rheocasting process.

9. The method of claim 1 wherein casting the first casting section and the second casting section comprises forming the first surface of the first casting section with a tongue and forming the first surface of the second casting section with a groove configured to mate with the tongue of the first surface of the first casting section.

10. The method of claim 9, wherein casting the first casting section and the second casting section comprises forming the second surface of the first casting section with a second groove and forming the second surface of the second casting section with a second tongue configured to mate with the second groove of the second surface of the first casting section.

11. A method for fabricating a hollow automotive part, the method comprising:

forming an upper mold and a lower mold;

injecting a charge of a semi-solid aluminum slurry into each of the upper mold and the lower mold to form an upper section in the upper mold and a lower section in the lower mold, wherein each section is formed with a lowest material porosity region at a first surface and at a second surface, wherein the first surfaces are formed with first mating geometric designs, and wherein the second surfaces are formed with second mating geometric designs;

engaging the lowest material porosity regions of the upper section with the lowest material porosity regions of the lower section; and performing a capacitive discharge welding process to weld the first surface of the upper section to the first surface of the lower section and the second surface of the upper section to the second surface of the lower section to form the hollow automotive part as a ring shape in which a closed void is surrounded by the upper section and the lower section.

12. The method of claim 11 wherein:

the first surface of the upper section is formed with a tongue and the first surface of the lower section is formed with a groove; and engaging the lowest material porosity regions of the upper section with the lowest material porosity regions of the lower section comprises inserting the tongue into the groove.

13. The method of claim 12 wherein:

the second surface of the upper section is formed with a second tongue and the second surface of the lower section is formed with a second groove; and engaging the lowest material porosity regions of the upper section with the lowest material porosity regions of the lower section comprises inserting the second tongue into the second groove.

14. The method of claim 11 further comprising forming the semi-solid aluminum slurry by heating an ingot comprising an aluminum material at a temperature of at least the melting point of the aluminum material to melt the ingot.

15. The method of claim 11 further comprising creating the semi-solid aluminum slurry with a gas induced semi-solid (GISS) process.

16. The method of claim 11 further comprising creating the semi-solid aluminum slurry with a swirled equilibrium enthalpy device (SEED) process.

* * * * *